United States Patent [19]

Dillingeretal.

[11] 3,972,254

[45] Aug.3,1976

[54] CUTTINGMECHANISM AND METHOD FOR CUTTING OR SLICING STRIPS FED THERETO

[75] Inventors: Edward George Dillinger, Levittown, Pa.; Wallace Jared Camp, Willingboro, N.J.

[73] Assignee: Kemos Incorporated, Marietta, Ga.

[22] Filed: Jan. 20, 1975

[21] Appl. No.: 542,483

[52] U.S. Cl. ..... 83/4; 83/578; 83/661; 83/788; 83/831

[51] Int. Cl.[2] ..... B26D 1/46; B26D 3/28

[58] Field of Search ..... 83/578, 661, 4, 830–834, 83/778, 793, 838, 839, 840, 844, 788

[56] References Cited

UNITED STATES PATENTS

| | | | |
|---|---|---|---|
| 286,706 | 10/1883 | Kay | 83/661 |
| 780,476 | 1/1905 | Bens | 83/839 X |
| 1,920,591 | 8/1933 | Pesci | 83/578 X |
| 3,179,317 | 4/1965 | Voelker | 83/4 X |
| 3,192,976 | 7/1965 | Clock | 83/4 X |
| 3,277,846 | 10/1966 | Kesselman | 83/4 |
| 3,395,204 | 7/1968 | Olsson et al. | 83/661 X |
| 3,850,061 | 11/1974 | Wirstrom | 83/578 X |

FOREIGN PATENTS OR APPLICATIONS

| | | | |
|---|---|---|---|
| 790,033 | 1/1958 | United Kingdom | 83/578 |

*Primary Examiner*—J. M. Meister

[57] ABSTRACT

The present invention is concerned with a novel and improved cutting mechanism for slicing a flexible sheet that is being advanced endwise continuously to the cutting position. It is particularly advantageous in the slicing of textile materials that are formed continuously as in a carpet making machine, such as those produced by a non-woven bonding procedure described in U.S. Pat. No. 3,657,052.

The present invention comprises an endless belt stretched about two sprockets. The cutting elements are secured to the belt at intervals therealong. Supporting guide means are positioned beneath the upper course or stretch of the belt to assure that the cutting edges of the cutting elements carried thereby follow a path lying in the plane of cutting extending transversely of the width of the sheet being sliced. Means is provided to drive the belt alternately in both directions so that these knives can be reciprocated in the plane of cutting. Means is also provided for adjusting the stroke of reciprocation and in a preferred embodiment, the return stroke is somewhat greater than the forward stroke or vice versa so that there is periodic complete cycling of such a belt and all of the knives are used efficiently.

10 Claims, 5 Drawing Figures

CUTTING MECHANISM AND METHOD FOR CUTTING OR SLICING STRIPS FED THERETO

DESCRIPTION OF THE INVENTION

Figure 1:
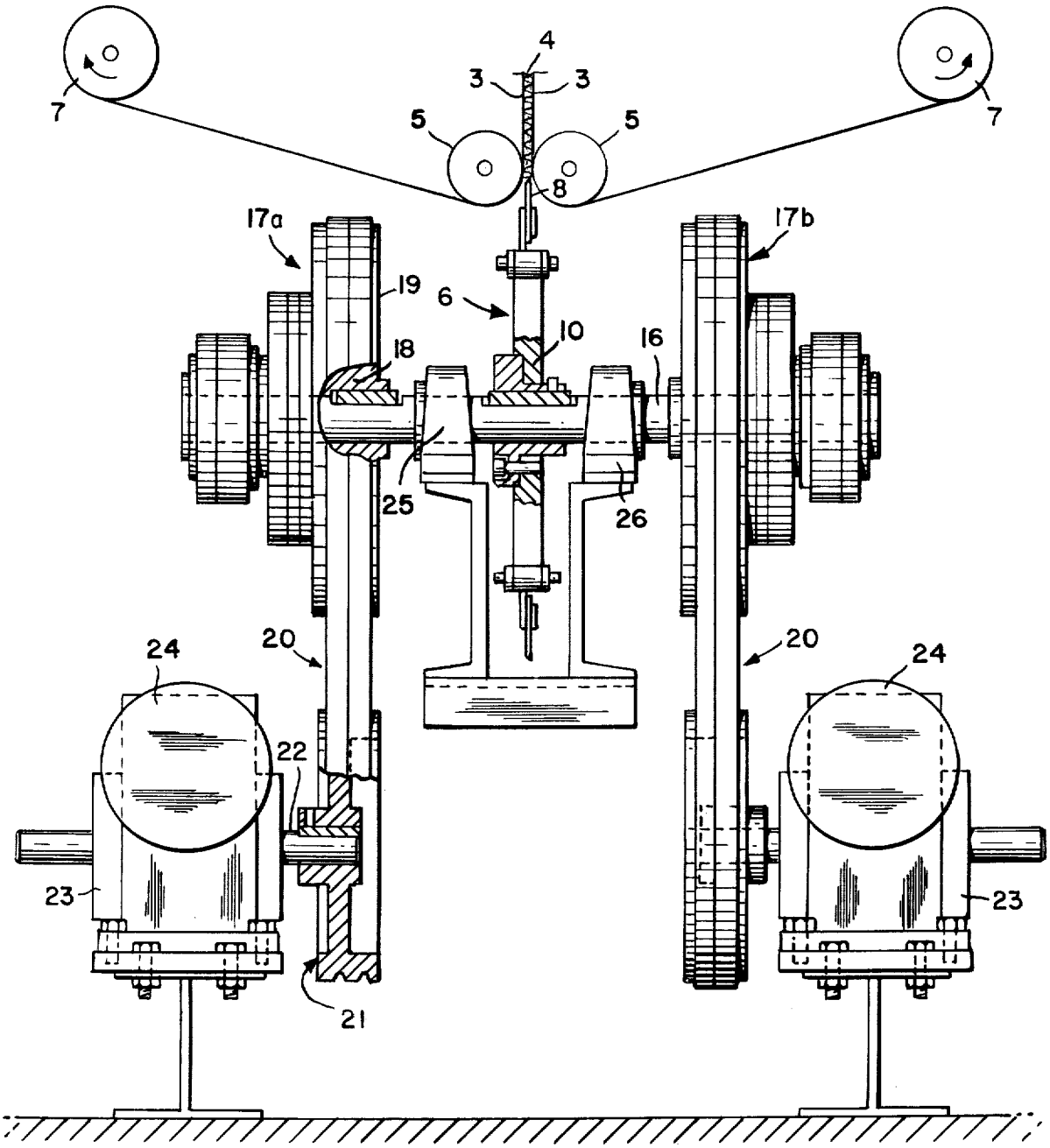

The present invention is concerned with an improved cutting device, especially adapted to slice a flexible sheet-like material being fed endwise to the device along a plane extending widthwise of, and lying in, the body of the approaching material that is transverse to the thickness dimension.

The new cutting device comprises belt means movable lengthwise through a circuital or endless path or loop having an upper course or stretch and a lower course or stretch, a plurality of planar cutting elements secured to the belt means, spaced longitudinally therealong and projecting outwardly therefrom in a common plane, means for supporting the belt means for longitudinal movement in either direction in its path comprising (a) spaced rotary means engaging the inside periphery of the belt means at the ends of the upper course and (b) stationary guide means under the upper course in a position to guide and support the belt means in a substantially straight line along the upper course, and means for reciprocating the belt means longitudinally with respect to its circuital path, each cutting element having a cutting edge in the common plane and sloped from its extremity on both sides thereof.

In the description hereinafter, preferred embodiments are mentioned and the advantages are discussed. However, it is to be understood that the drawing merely illustrates the best mode now contemplated of carrying out the invention. The drawing and description thereof are directed to a worker skilled in the art.

Figure 2:
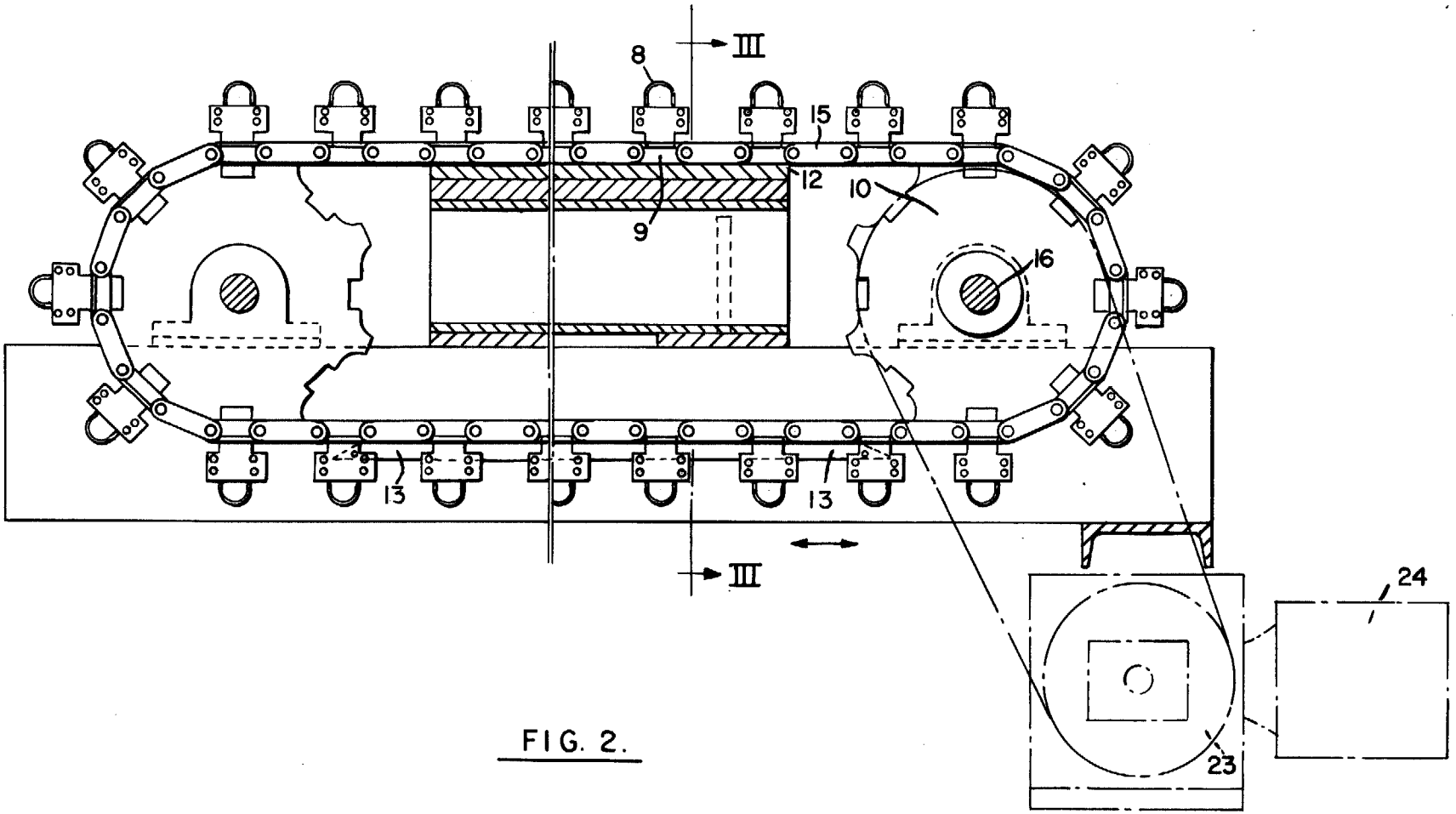
Figure 3:
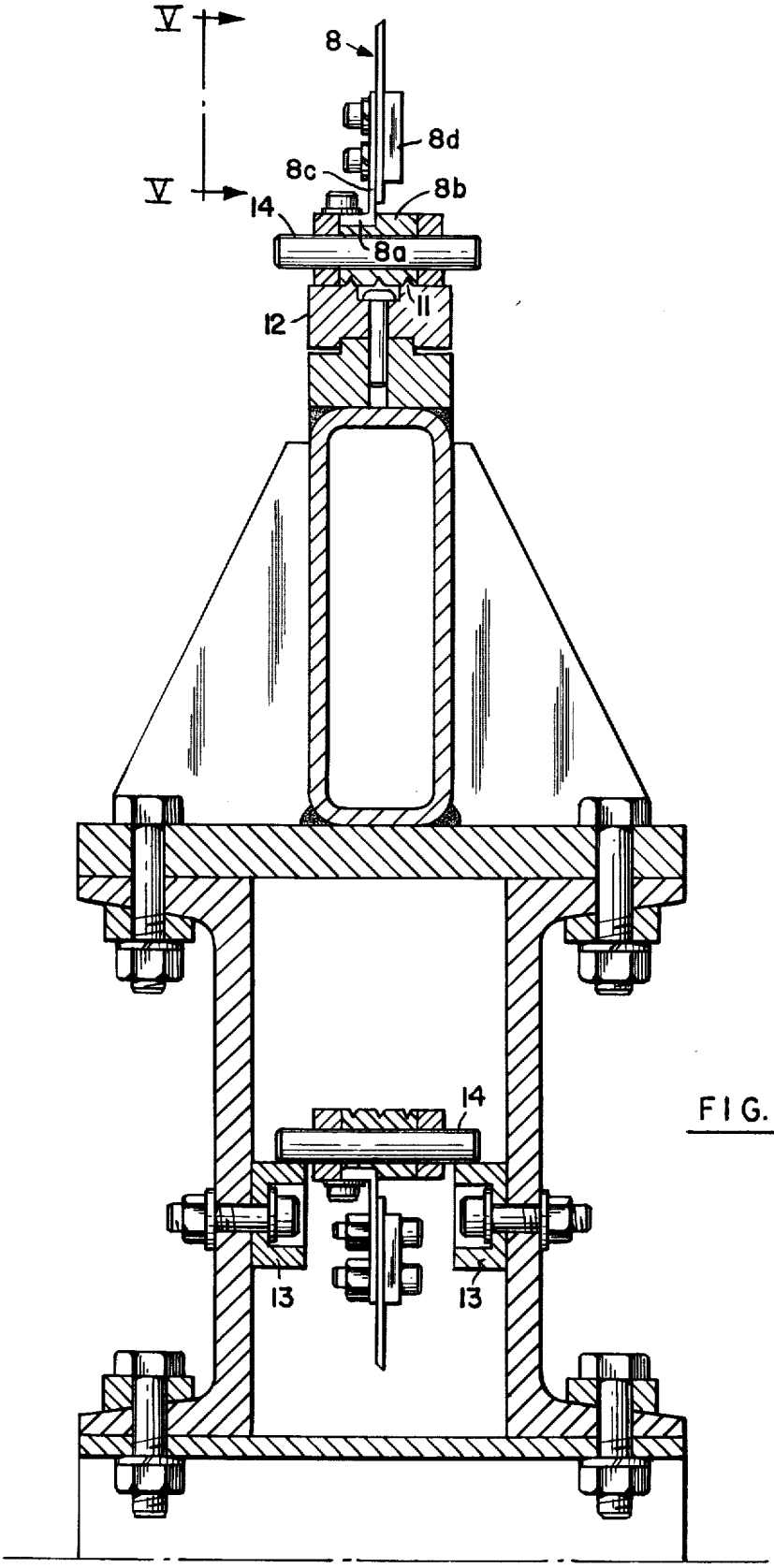
Figure 4:
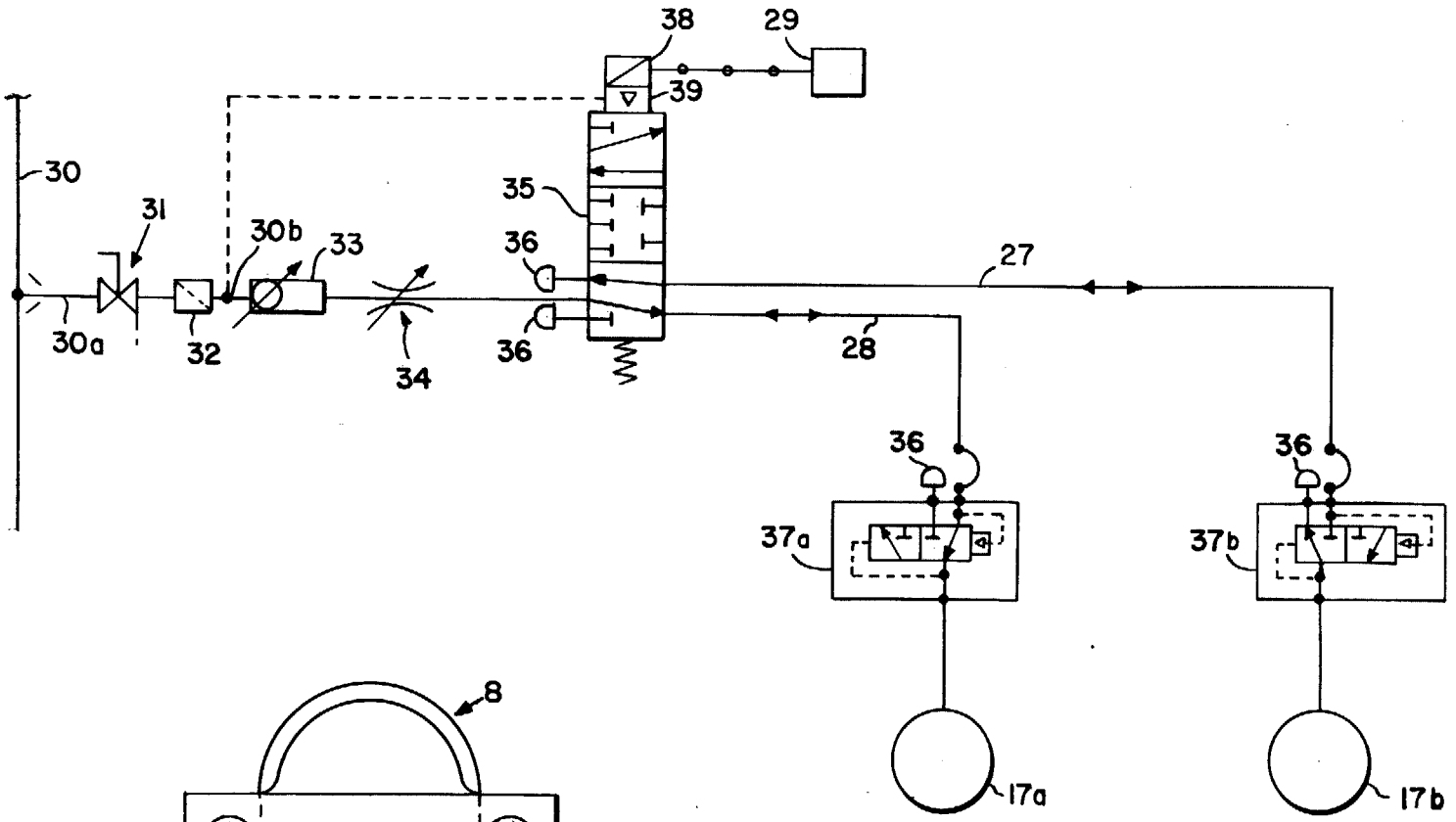
Figure 5:
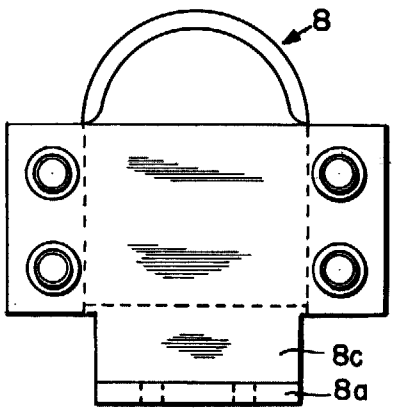

In the drawing,

FIG. 1 is an end elevation, somewhat diagrammatic in part, and partly in section, of the cutting device showing its relation to a flexible sheet to be slit by the device, and its driving means, FIG. 2 is a side elevation, partly diagrammatic and partly in section, with some supporting structure removed to expose the lower course of the blades of the cutting device, FIG. 3 is an end elevation showing the guiding means for the belt cutter, FIG. 4 is a schematic diagram showing a pneumatic control for reciprocating the endless belt cutter, FIG. 5 is an enlarged face view of a cutting element mounted in a holder.

The cutting device of the present invention essentially consists of an endless belt supporting a plurality of individual blades or knife elements spaced at intervals along the circumferential length of the belt. The belt means may be formed of a flexible band such as of a chain of steel or other metallic links joined with pins as in conventional chain link belts. The individual planar cutting elements or blades are secured to the outer face of the belt means by a suitable adhesive, by riveting or by mounting in a holder or clamp fastened to the belt by adhesive, rivets, bolts, or screws. In the preferred embodiment shown hereinafter, the individual blades or knife elements are clamped in rigid holders fixedly secured to spaced center links of a chain link belt. Since the upper course of the endless belt means normally provides the effective cutting zone of the belt, and since, in the present invention, there is provided supporting guiding means for the upper course or stretch of the belt means between spaced rotary means at the ends of the loop, either a flexible continuous band (of leather, plastic, or steel) or a chain link belt may be employed to provide cutting in a definite plane above the upper course of the belt means. However, in the preferred embodiment of the invention as shown in the drawing, the endless belt means is of the chain link type, which provides the greatest assurance of maintaining accurate alignment of the cutting edges of the reciprocating cutting elements in the common cutting plane.

As shown in FIG. 1, a flexible sheet to be sliced, such as a fibrous laminar sheet having a dual backing, is fed downwardly from a suitable source. For example, this laminate may be formed of two backing sheets 3, e.g., of burlap, to the opposed faces of which intervening yarns 4 extend and are glued or cemented. The sheet moves vertically downwardly about suitable guide rolls 5 which extend the full width of the sheet (the dimension thereof perpendicular to the plane of view shown in FIG. 1) on either side of the position where the endless belt cutter having the blades 8 slices the fibrous sheet in two, from which position the two products resulting from the slicing are taken up by suitable winding cores or drums 7.

As shown in FIG. 2, the endless belt cutting device comprises a plurality of individual knife elements 8 secured at spaced (preferably regular or equidistant) intervals about the endless belt cutter, as by being clamped in a holder 6 rigidly secured to each center link 9 of a chain making up the belt. The upper course of the endless belt cutter extends across the entire width of the sheet to be cut or of the machine that forms such a sheet and feeds the sheet to the upper course of the endless belt cutting device. Rotary means 10 at each end of the loop engage the inner periphery of the belt means and stationary guide means 12 under the upper course of the belt support the belt slidably thereon. The means 10 shown comprise sprockets mounted on parallel axes of rotation and the guide means 12 is a fixed rigid rail having one or more longitudinal ribs or ridges 11 on its upper surface (See FIG. 3). The inner periphery of the belt means has one or more longitudinal grooves mating with the ribs 11. As shown, the inside surface of the center chain links that ride over this rail 12 is provided with one or more grooves mating with the ridges 11. This assures that the cutting edges of the knife elements projecting outwardly from the belt lie in a common plane (the plane of slicing) extending the full length of the upper course.

As shown in FIG. 3, the lower course of the belt cutter rides over two fixed rails 13 extending longitudinally beneath the endless belt cutter. The pins 14 linking the center links with the intervening paired side links 15 project to each side of the outer links 15 so that the projecting ends of these pins ride over the rails 13. This arrangement of guide means supporting the upper stretch of course of the endless belt cutter and guide means slidably supporting the endless belt along its lower stretch or course assures that excessive tension or irregular tension is avoided in driving the endless belt from one of the sprockets 10.

Means for driving the endless belt cutter is shown in FIG. 4 and at one end of FIG. 2. The rotary means comprising sprocket 10 at one end of the endless cutter loop is keyed to its shaft 16 which carries on its outboard end clutches 17*a* and 17*b* (see FIG. 1). The shaft 16 is supported for rotation in suitable bearings 25 and 26 fixed on each side of the rotary driving means drive element 10. Any suitable clutches may be employed. For instance, each of them may have an inner rotor 18 fixed to the shaft 16 for rotation therewith within an outer annulus 19 which is normally "free-wheeling" about the inner hub or rotor 18. The outer annulus 19 of each clutch is provided with an external grooved periphery so that it serves as a sheave.

Two motors 24 are mounted at the drive end of the machine, one on each side of the endless cutter. The motors each drive a respective pulley or sheave 21 through a reduction gear box 23, the output shaft 22 of which is fixed to the driving pulley 21. One or more belts ride in the grooves of pulley 21 and about the grooves of the outer annulus 19 of the corresponding clutch. During operation of the cutter, both motors drive the outer annuli 19 simultaneously, one of the annuli being driven in the opposite direction to that of the other. The inner rotor 18 is provided with arcuate clutching shoes that are normally retracted out of engagement with the inner clutching surface of the "free-wheeling" outer annulus. The shoes of each inner rotor of the clutch may be caused to engage the clutching surface of the outer annulus by any suitable means such as electric, pneumatic or hydraulic systems.

Both motors 24 operate continuously, one driving its free-wheeling annulus 19 in a direction opposite to that of the other so that when one of the clutches (e.g., 17*a*) is engaged, its rotor 18 fixed to shaft 16 drives the sprocket 10 in one direction whereas when this clutch is disengaged and the other clutch (e.g., 17*b*) is engaged, the drive shaft 16 will be rotated in the opposite direction.

The reciprocation of the endless cutter is accomplished by alternately engaging one clutch while disengaging the other. A pneumatic system for controlling this engagement and disengagement of the clutches automatically is shown in FIG. 4, but it is to be understood that the invention is not limited to this particular drive means shown.

The diagram in FIG. 4 uses the USA Y32.10 — 1967 standard "Graphic Symbols for Fluid Power Diagrams" published by The American Society of Mechanical Engineers. See also "Hydraulics & Pneumatics," March, 1967, pp. 90–93. In this figure, 29 is a timer which delivers signals to the solenoid 38 of the two-position, single-solenoid, spring-return, external pilot, five-way directional valve 35. A power air line 30 contains compressed air at any suitable pressure such as 50 to 100 pounds per square inch gage. A branch line 30*a* connects this power line to a shut-off valve 31 with downstream bleed. This valve is connected to a filter 32 and to an "air pressure regulator and lubricator" 33 from which the air proceeds to an adjustable flow-control valve 34. The dotted line extending from a point 30*b* in the line between the filter and the pressure regulator to 39 represents the conduit (from 30*b*) for the external pilot air for operating the spool in valve 35. The symbol 39 associated therewith indicates the usage of pilot air. Conduits for pilot air in or to all valves, whether external or internal, are shown in dotted lines. Mufflers associated with exhaust ports in various valves are designated by the semi-circle identified with reference character 36. The valve 35 is normally urged by the spring shown in the diagram into one position wherein the flow of air proceeds through the line 28 to the valve 37*a* to energize the clutch 17*a;* in this spring-biassed position of valve 35, the air line 27 to the other clutch 17*b* is disconnected from the power line and clutch 17*b* is disengaged, its respective valve 37*a* having been shifted to the quick-release position.

In the other position of valve 35, wherein the energization of the solenoid by the timer causes the pilot air to shift the spool of the valve, the air is directed through the line 27 and through the quick-release valve 37*b* connected to clutch 17*b*. This energizes clutch 17*b*. When air through line 27 engages clutch 17*b*, line 28 is disconnected from the source of air and this causes the release of clutch 17*a* and the discharge or venting of air through the quick release valve 37*a* connected thereto.

The timer in FIG. 4 may be any suitable dual timed on-off signal relay. For example, the first signal from the timer energizes the solenoid 38 to cause the external pilot air valve 39 to become effective to shift the spool of valve 35 which then directs the power air through line 27 and through valve 37*b* to actuate the clutch 17*b*. The timer holds this signal for a period that is adjustable in duration at the end of which period, the first signal ceases, thereby de-energizing the solenoid and allowing the spring to shift the spool of valve 35 into the other valve position. This shifts the power air into line 28 instead of line 27 thereby releasing clutch 17*b* and actuating clutch 17*a*. The duration of this solenoid-deenergized condition can be adjusted to be the same as the solenoid-energized condition or either longer or shorter. Once set, the timer repeats the cycle just described, whereby the belt cutter is alternately driven forward for a predetermined time and hence distance and reversed a predetermined time and hence distance which may be the same as or different than the forward stroke. If the time of duration of the alternate periods (energized and de-energized states of solenoid 38) are equal, the belt cutter would have forward and return strokes of equal length. However, the timer is preferably adjusted to lengthen one of the alternate intervals relative to the length of duration of the other. In this fashion, the forward stroke of the belt may be of a different length than the return stroke. For example, the belt may be driven in one direction for a distance of 20 cm. and returned a distance of 25 cm. so that for each cycle of reciprocation, the belt will shift an additional 5 cm. in one direction so that the knife blades in use at a particular cycle of movement of the belt are shifted gradually. This results in the periodic use of the entire set of knives about the belt periphery without the necessity to periodically stop the cutter and shift a different portion of the belt into cutting position.

Besides relying on the timer to provide a difference in length of the return stroke relative to the forward stroke, such a difference in length of stroke may also be accomplished in other ways, e.g., simply by providing one of the sheaves 21 of somewhat smaller or larger diameter than the other or by motors running at different speeds or by using different reduction ratios in the speed reducers 23 operated by the motors, etc. The particular length of stroke is not critical. However, it is preferred that a minimum length of stroke be used that will equal or exceed the distance between the center lines of succeeding cutter elements or blades 8 as measured longitudinally of the belt. While the drawing shows each center link of the chain having an upstanding knife blade secured rigidly thereto, it is not necessary that all of them be so provided. Thus, the spacing between successive blades may involve intervals comprising one or more center links which do not carry a blade.

As shown in FIG. 5, each center link which carries a blade or cutter element 8 has a holder 6 having a base leg 8*a* which is rigidly secured as by bolts, rivets, or screws, to the center link 8*b* and another standing leg 8*c* against one face of which the blade 8 is clamped as by cap screws extending through the leg 8*c*, and a backing or locking plate 8*d*. The individual knife element 8 is in the form of a flat plate lying in the plane of slicing and has a cutting edge sloped away from the outer extremity of the element on each side of the extremity so that the cutting edge is effective regardless of the direction of reciprocation of the knife in its plane. As specifically shown in FIG. 5, the outer end of the individual knife elements is in the form of a circular arc (approaching a semicircle) and this arc is sharpened to provide the cutting edge which is effective on both sides of the cutter so that cutting occurs during reciprocation.

We claim:

1. A cutting device comprising belt means movable lengthwise through an endless path or loop having an upper course and a lower course, a plurality of planar cutting blades secured to the belt means, spaced longitudinally therealong and projecting outwardly therefrom in a common plane, means for supporting the belt means for longitudinal movement in either direction in its path comprising (a) spaced rotary means engaging the inside periphery of the belt means at the ends of the upper course and (b) stationary guide means under the upper course in a position to guide and support the belt means in a substantially straight line along the upper course, and means for reciprocating the belt means longitudinally in its path, wherein the reciprocating means comprises means for moving the belt different forward and return stroke distances, whereby all of the cutting blades on the belt periodically make a complete cycle through the path.

2. A device according to claim 1 in which each of the cutting blades has a cutting edge lying in the common plane and sloped from the blade's outer extremity on both sides thereof so that the edge is effective during both strokes of reciprocation.

3. A device according to claim 2 in which the cutting edge curves gradually about the blade's outer extremity.

4. A device according to claim 2 in which the cutting edge is approximately a semicircular arc.

5. A cutting device comprising belt means movable lengthwise through an endless path or loop having an upper course and a lower course, a plurality of planar cutting blades secured to the belt means, spaced longitudinally therealong and projecting outwardly therefrom in a common plane, means for supporting the belt means for longitudinal movement in either direction in its path comprising (a) spaced rotary means engaging the inside periphery of the belt means at the ends of the upper course and (b) stationary guide means under the upper course in a position to guide and support the belt means in a substantially straight line along the upper course, and means for reciprocating the belt means longitudinally in its path, wherein the stationary guide means (b) comprises a fixed rigid rail having longitudinal rib means on its upper surface with respect to which mating longitudinal groove means in the inner periphery of the belt means cooperate during relative longitudinal movement between the guide means (b) and the belt means.

6. A cutting device comprising a chain link belt having a plurality of center links pivotally connected to alternating pairs of side links, the belt being movable lengthwise through an endless path or loop having an upper course and a lower course, spaced rotatable sprockets mounted on horizontal shafts and engaging the inside periphery of the belt at the ends of the upper course, a plurality of planar cutting blades rigidly attached to separate center links and projecting outwardly therefrom in a common plane, stationary guide means under the upper course in a position to guide and support the belt in a substantially straight line along the upper course, and means for reciprocating the belt longitudinally in its path, the reciprocating means comprising one of the sprockets secured to its respective shaft for rotation therewith, means for rotating the shaft in one direction, first clutch means for controlling said shaft-rotating means, means for rotating the shaft in a direction reverse to that of the first shaft-rotating means, second clutch means for controlling the last-mentioned shaft-rotating means, and means for alternately (a) engaging the first clutch means while disengaging the second and (b) engaging the second clutch means while disengaging the first.

7. A device according to claim 6 wherein the stationary guide means (b) comprises a fixed rigid rail having longitudinal ribs on its upper surface with respect to which mating longitudinal grooves in the inner periphery of the belt means cooperate during relative longitudinal movement between the guide means (b) and the belt means.

8. A device according to claim 6 comprising means for controlling the engagement of the first and second clutches to predetermine independently the distance of forward motion and the distance of return motion.

9. A device according to claim 6 comprising guide means along the lower course to support the lower stretch of the link chain belt slidably therealong.

10. A device according to claim 6 wherein the upper and lower courses are horizontal.

* * * * *